United States Patent [19]

Schott, Jr.

[11] 4,043,458

[45] Aug. 23, 1977

[54] STACKER

[75] Inventor: Charles M. Schott, Jr., Gloucester, Mass.

[73] Assignee: Gloucester Engineering Co., Inc., Gloucester, Mass.

[21] Appl. No.: 663,210

[22] Filed: Mar. 2, 1976

[51] Int. Cl.[2] ..... B65H 31/32

[52] U.S. Cl. ..... 214/6 D; 93/93 DP; 198/422; 214/8.5 SS; 271/213; 271/218

[58] Field of Search ..... 214/6 D, 6 S, 8.5 SS; 271/35, 116, 213, 218; 93/93 R, 93 DP; 198/422, 425, 430

[56] References Cited

U.S. PATENT DOCUMENTS

| | | | |
|---|---|---|---|
| 1,655,804 | 1/1928 | Zuckerman | 93/93 DP |
| 2,235,347 | 3/1941 | Zahutnik | 214/6 D X |
| 3,191,927 | 6/1965 | Hartbauer et al. | 214/6 D X |
| 3,362,707 | 1/1968 | Lauren | 271/218 |
| 3,596,575 | 8/1971 | Brockmuller | 271/183 X |
| 3,867,876 | 2/1975 | Van de Gent | 93/93 DP |

*Primary Examiner*—L. J. Paperner

[57] ABSTRACT

A bag stacker useful for plastic bags having a fence for stopping forwardly projected bags, raisable to permit a completed stack to move forward, a conveyor passing beneath the fence, a clamp moving with the conveyer to draw the completed stacks forward beneath the fence and a bag support arranged to assume, when the clamp engages a completed stack of bags, a position rearward of the fence, to receive and support bags arriving subsequently, this support being movable forward of the fence to disengage from accumulated bags. Preferably fingers extend below the fence and have trailing ends movable between raised and lowered levels and from a rearward position in which the ends extend rearwardly beyond the fence.

These fingers move to the forward position prior to raising the fence and to the rearward position when the fence is raised and before the support is drawn forward of the fence, to insert the finger ends into the space between the clamp and support and thereby between completed and newly forming stacks.

The support joins the clamp in a narrow edge facing incoming bags; the fence is counterbalanced, preferably free floating down, and rests lightly on the conveyor or stack; and the fence is mounted on rotary arms, preferably a parallelogram, pivoted to the supports to carry the fence close to the conveyor in bag-stopping position over the range of vertical adjustment. The conveyor and clamp travel in parallel paths driven by an adjustable stroke rack with a clutch enabling reverse motion only of the drive belt for the clamp motion of the rack.

17 Claims, 12 Drawing Figures

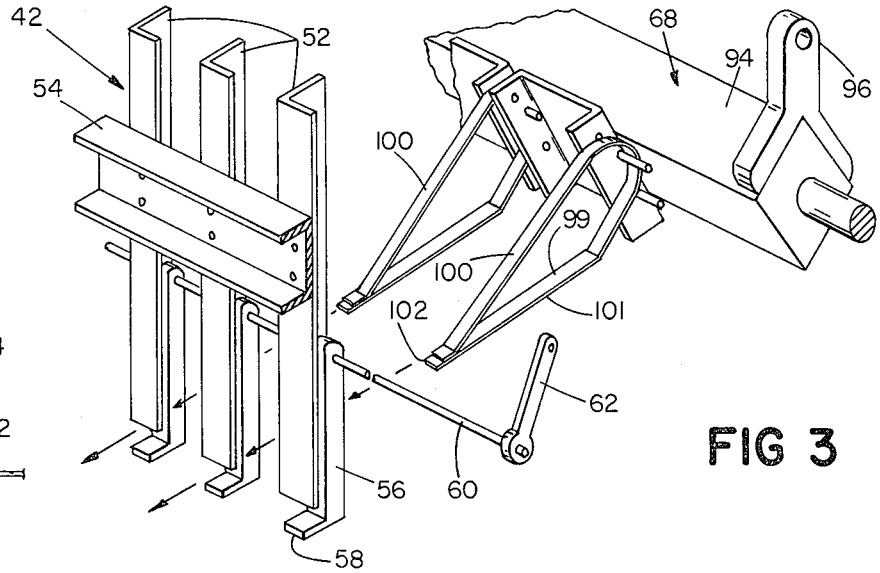
FIG 3
FIG 4
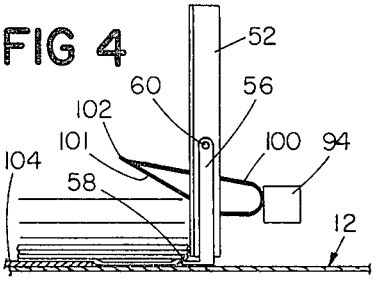
FIG 5
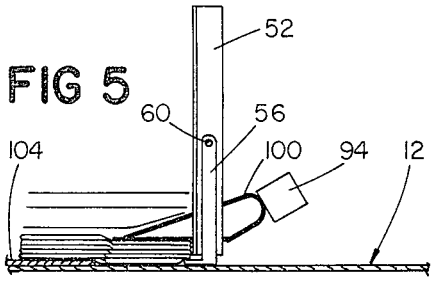
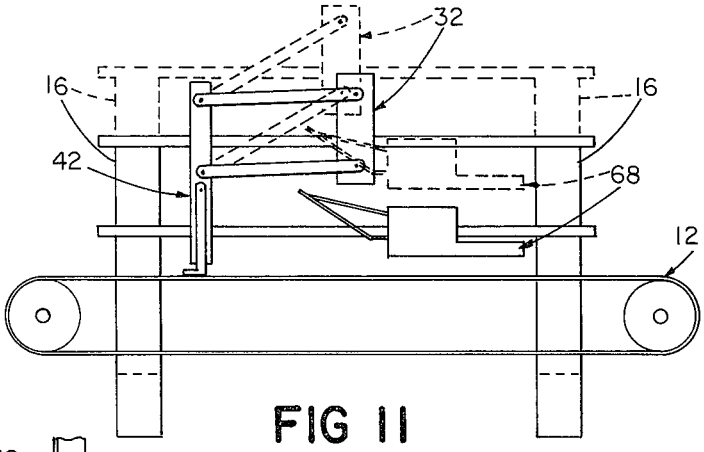
FIG 11
FIG 6
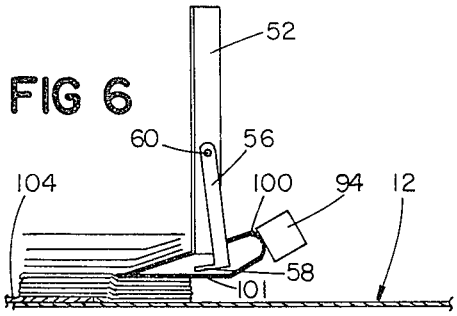
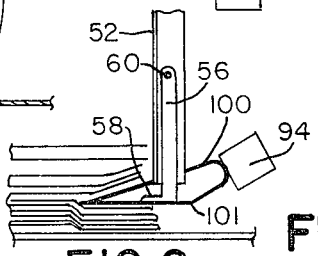
FIG.6a
FIG 7
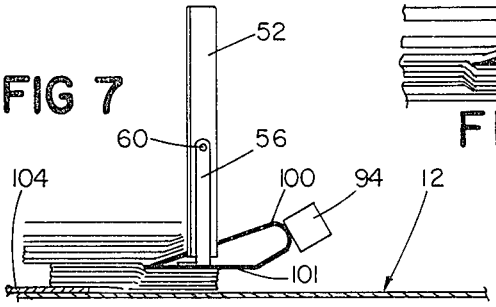
FIG 8
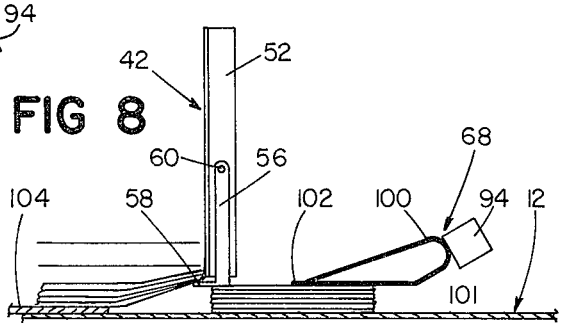
FIG 9
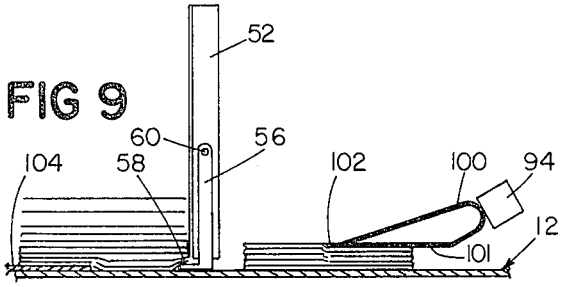
FIG 10
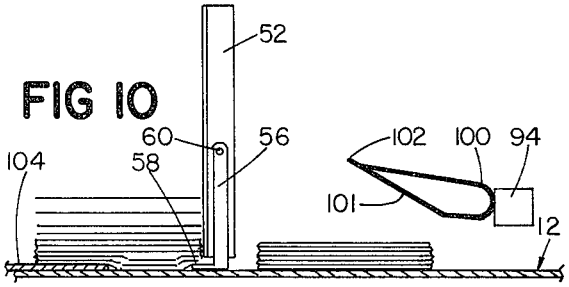

STACKER

BACKGROUND OF THE INVENTION

This invention relates to bag stacking apparatus.

Heretofore bag stackers, especially those operating on plastic bags have encountered difficulties in operating with an uninterrupted stream of incoming bags while intermittently withdrawing completed stacks of bags. The difficulties have been particularly severe when it was desired to produce fully separated stacks as contrasted to producing overlapping or shingled stacks.

SUMMARY OF THE INVENTION

The invention relates in its various aspects to a bag stacker for plastic bags and the like having a fence for stopping forwardly projected bags so that they accumulate in a stack and raisable to permit completed stacks to move forward, a movable conveyor passing beneath the fence, and a clamp for clamping completed stacks of bags against the conveyor and moving with the conveyor to draw completed stacks forward beneath the fence.

According to one aspect of the invention a receiver surface is provided, operative to lie over the conveyor and stack and extending to the fence when the fence is in raised position. This receiver surface is adapted to receive bags thereupon while the clamp moves forwardly with the previously formed stack, and the receiver surface is adapted to move forwardly beyond the fence whereby bags formed during forward motion of the clamp are released to fall by gravity upon the conveyor, and freeing the receiver surface to return above the next completed stack for repetition of the cycle.

Preferably this receiver surface terminates rearwardly in a narrow edge facing incoming bags, and it may be movable with the clamp during forward movement of a clamped stack or it may be independent of the clamp, constructed to remain in receiving position while the clamp moves entirely beyond the fence.

According to another aspect of the invention a bag support is arranged to assume, when the clamp engages a completed stack of bags, a position rearward of the fence and above the clamp and the completed stack clamped thereby to receive incoming bags thereon, thereby supporting bags arriving subsequently to the clamping of a completed stack by the clamp, this support being further arranged to move forward of the fence so as to disengage bags accumlated thereon, and fingers are provided extending below the fence and having trailing ends, these fingers being movable to a raised and a lowered level and from a rearward position wherein their ends extend rearwardly beyond the fence to a forward position in which the ends do not extend rearwardly of the fence.

The clamp, fingers and support are arranged so that at their raised level the finger ends are positioned above the clamp and below the support, and means are provided for moving the fingers to the forward position prior to raising the fence and to the rearward position when the fence is in its raised position and before the support is drawn forward of the fence, to insert the finger ends into the space between the clamp and support and thereby between completed and partial stacks.

Preferably the support joins the clamp in a narrow edge facing incoming bags, and the fence is counterbalanced so that the fence rests lightly on the conveyor, the clamp has a range of movement to move stacks entirely past the fence, thereby forming non-overlapping stacks, and the support and clamp are vertically adjustable to accommodate various stack heights.

According to another aspect of the invention, supports for the clamp and fence are adjustable vertically together on ways over a range of levels above the conveyor, and the fence is mounted on rotary arms pivoted to the supports and arranged to carry the fence close to the conveyor in bag-stopping position over the range of adjustment. Preferably the fence is mounted on a parallelogram linkage whereby its angular relation to approaching bags does not substantially vary over the range of adjustment and preferably means are provided for raising the fence and/or releasing the fence to fall by gravity, and counterbalance means adjusts the effective weight of the fence to enable it to rest lightly upon a stack of bags being moved by the conveyor.

According to another aspect of the invention the conveyor comprises an endless conveyor belt including an upper segment arranged in a given path for conveying the stacks, the clamp is mounted to travel in a path parallel to this upper segment, a drive belt is associated with the clamp, sprockets are provided for driving the conveyor and drive belts, an adjustable stroke rack is provided for the sprockets in dependent motion in stackconveying direction, and clutch means enable reverse motion only of the drive belt during return motion of the rack.

BRIEF DESCRIPTION OF DRAWING

FIG. 3 shows in greater detail portions of the stacker of FIGS. 1 and 2.

FIGS. 4 through 10 show the sequence of operation of certain elements of the stacker.

FIG. 11 shows the manner in which the stacker adjusts to accommodate to various heights of stacks.

DESCRIPTION OF PREFERRED EMBODIMENT

Figure 1:
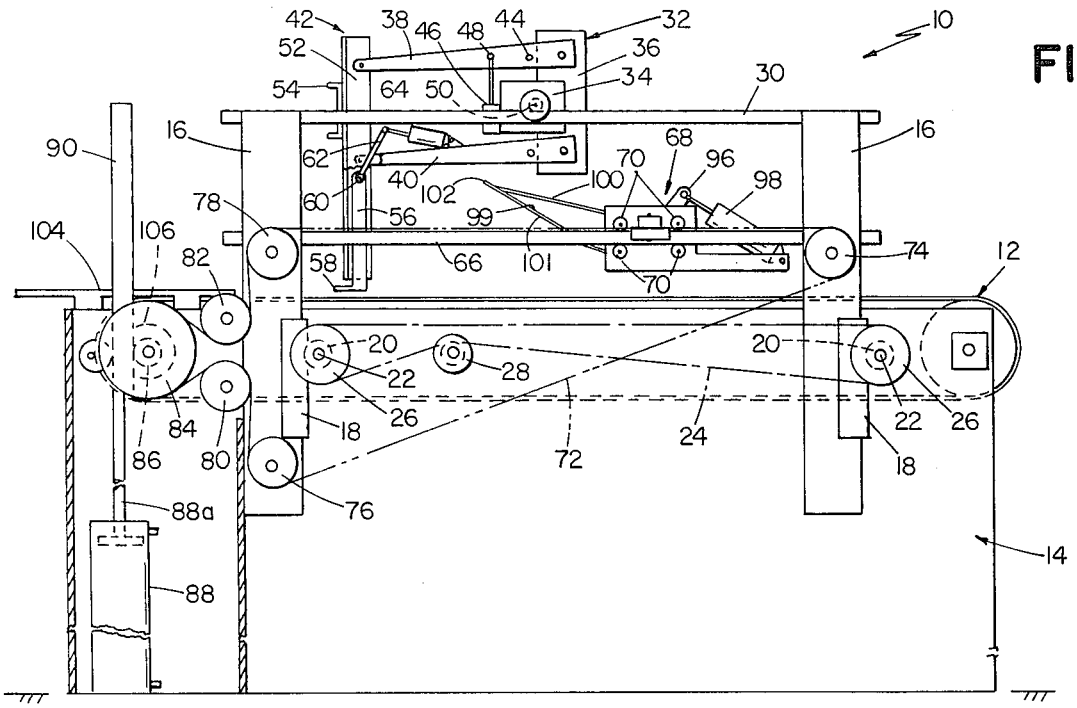
FIG. 1 shows a somewhat schematized elevation view of a bag stacker according to the invention.
Figure 2:
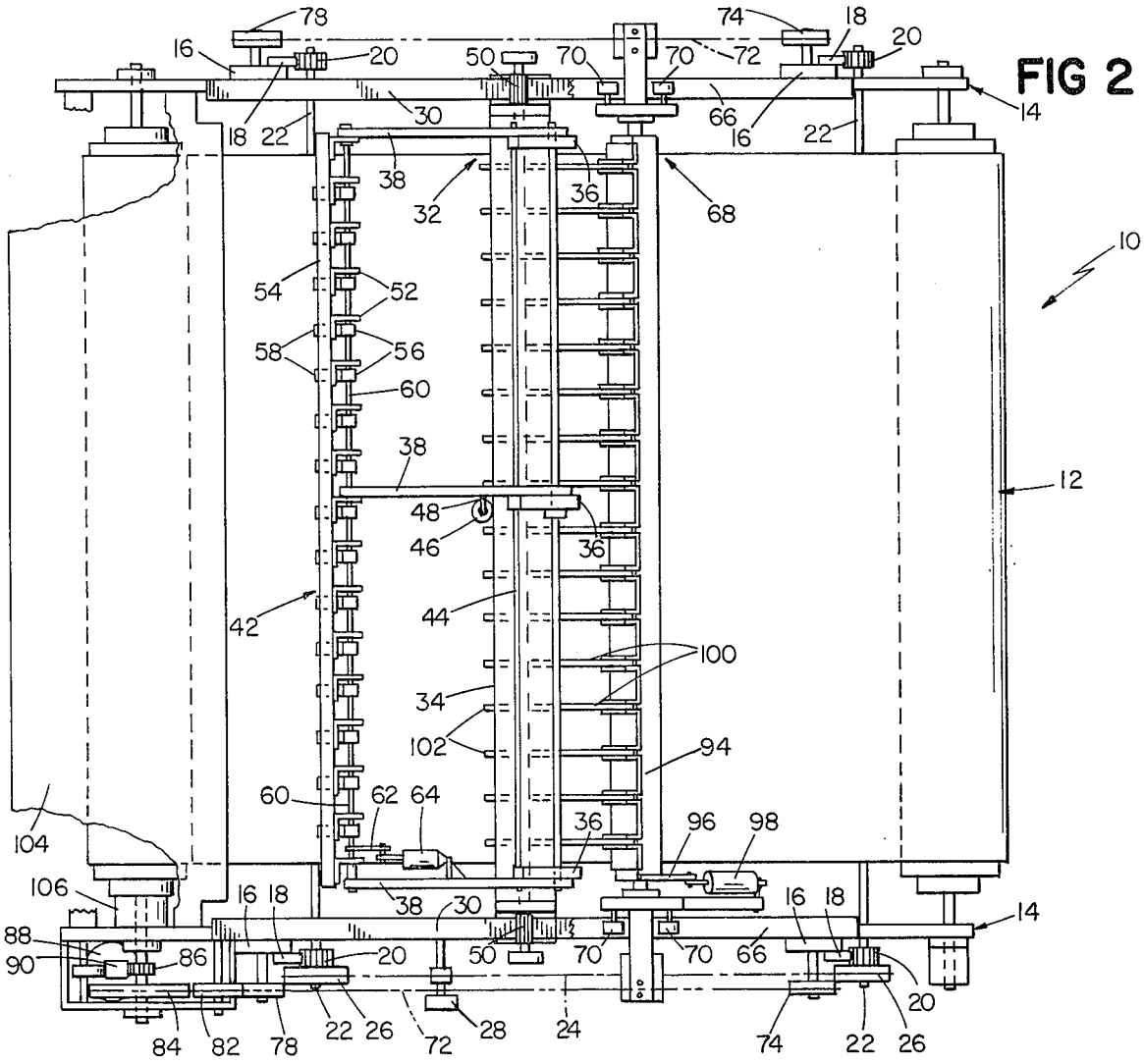
FIG. 2 shows a plan view of the stacker of FIG. 1.

Bag stacker 10 embodying the invention includes a stacking mechanism supported on frame 14 above conveyor 12. (As portrayed in FIG. 1, the top of conveyor 12 moves to the right). Four support pillars 16 are mounted on vertical ways on frame 14. Cross shafts 22, supported on frame 14, are affixed to sprocket gears 26 and to pinions 20 which engage racks 18 affixed to pillars 16. Sprocket chain 24 engages gears 26 and geared handle 28 so that by turning handle 28 all four pillars 16 are moved upwards or downwards in unison to adjust the height of the apparatus supported on the pillars above the conveyor 12. Ways 30 on each side of the stacker are supported on pillars 16 and in turn support fence assembly 32. Cross-beam 34 of fence assembly 32 spans the equipment and is supported on ways 30. Bracket 36 affixed to cross-beam 34 supports on bearings parallel arms 38 and 40 which in turn support on bearings fence structure 42. Torsion bars 44 are installed in fence assembly 32 and support the major portion of the weight of fence structure 42. Pneumatic piston 46 affixed to cross beam 34 has a shaft 48 engaging arm 38 to move fence structure up and down. Fence structure 42, a portion of which is shown in greater detail in FIG. 3, includes a series of vertical members 52 tied together by cross-bar 54. A finger 56 with a protruding end 58 hangs forward (i.e. downstream as the conveyor moves) of each vertical member 52 of fence structure 42, the tips 58 protruding backward beneath the members 52. The fingers 56 are affixed to a common shaft 60 connected to crank 62 which is in turn connected to be operated by pneumatic cylinder 84. The whole of fence assembly 32 can be moved forward or back on ways 30 by turning gear 50 mounted on cross beam 34 and engaging a rack 51 affixed to ways 30.

Two horizontal ways 66 are supported on each side of the equipment on pillars 16 below the level of ways 30. Clamp mechanism 68 is supported on ways 66 on cam followers 70, four of which are on each side of the apparatus so that clamp assembly may be moved along its ways. Clamp assembly 68 includes rotating shaft 94, as shown more particularly in FIG. 3, having crank 96 attached thereto which is driven by pneumatic cylinder 98. Affixed to shaft 94 in an array spanning the apparatus are a plurality of clamp arms 99. Clamp arms 99 are springy and have downward faces 101 adapted to press against the top of bag stacks as will be described hereafter. Associated with each arm 99 is a bag support 100, also affixed to bar 94. Each support 100 is positioned above its associated clamp arm 99, the arm 99 and associated support member 100 joining to form a thin edge 102 at their rearward extremity. Clamp assembly is of a form having low moment of inertia to facilitate rapid rotation as will be discussed below. The clamping arms 99 and associated support members 100 are arranged along bar 94 so that they inter-penetrate the vertical members 52 of fence structure 42.

The stacker 10 includes a drive mechanism wherein pneumatic cylinder 88 is the prime mover. Rack 90, affixed to the shaft of piston 88*a* is driven up and down by piston 88*a* and engages pinion 86 affixed to clamp sprocket drive gear 84 and connected to conveyor sprocket drive gear 102 through one-way clutch 106. Gear 102 is the same diameter as gear 84. Sprocket chain 72 passing over idler gears 80 and 82 mounted on frame 14 and idler gears 74, 76, and 78 mounted on pillars 16 is connected to clamp mechanism 68 to drive it back and forth on ways 66. Gear 102 is connected to drive conveyor 12. Platform 104 is supported on frame 14 above conveyor 12.

It will be understood that pneumatic supplies, valves, etc. of conventional design well known in the art are additionally included to effect operation of the equipment as hereafter described.

The operation of the apparatus is cyclical and it will be convenient to start its description at a point illustrated in FIG. 4 when a stack of bags has been about half formed. At this time fingers 56 hang straight downward with ends 58 extending beneath and rearward of fence elements 52; fence assembly 42 is at its lower position so that finger ends 58 are resting lightly on conveyor 12, which is stationary; bar 94 is rotated so that clamp arms 99 and bag supports 100 are raised above the top of the half-finished stack of bags; clamp assembly 68 is in its rearward position with its pointed edge 102 extending through and to the rearward of fence 42 and positioned above the level of the partially formed stack of bags; the half-completed stack of bags is resting on platform 104 with the forward edge of the stack extending beyond platform 104 and butting up against fence 42. Additional bags are now added to the top of the pile, each one sliding across the uppermost bag of the pile to be stopped when its forward edge bumps into fence 42. The incoming bags are counted by some conventional means and when the desired bag stack is completed, clamp mechanism 68 is actuated so that the clamp arms are rotated rapidly downwards to grip the completed bag stack between the lower face 101 of the clamp arms and conveyor 12. By virtue of rapid rotation of the clamp and its sharp edge 102, incoming bags will pass cleanly below the edge and come to rest beneath clamp 99 or will pass cleanly above the edge to come to rest on bag support 100 without risk of bumping and crumpling on the rear of the clamp mechanism. Incoming bags will now be stacked on top of bag supports 100 with their leading edges abutting against fence 42 as shown in FIG. 5. The next step in the operation is that fingers 56 are moved forward to disengage trailing ends 58 from beneath the completed stack of bags and then fence 42 is raised up to a point where its lower end is in the space between clamp arms 99 and bag supports 100 as shown in FIG. 6. Fingers 56 are then moved to their forward position so the ends 58 again protrude rearwards of the fence elements 52 and fence structure 42 is released by cylinder 46 to descent by its uncounterbalanced light weight to rest on the top of the completed stack of bags as shown in FIG. 6*a.* Because the major portion of the weight of fence is carried by torsion bars 44, there is only a slight weight on the stack of bags. At this point pneumatic cylinder 88 through the linkage described drives at equal speed conveyor 12 and clamp mechanism 68 forward (i.e. to the right as shown in FIG. 1) and the completed stack of bags now gripped between clamp arms 99 and conveyor 12 are pulled in a bundle to the right underneath fence 42 while the newly arrived bags above supports 100 are restrained from following by fence 42. As bag supports 100 are drawn forward of fence 42, of the bags of the new stack settle and are retained on finger ends 58. When the completed stack has been pulled from under the new stack but is still beneath the fence, as shown in FIG. 8, the finger ends keep the bottom bags of the new stack from falling under the fence. Finally when the completed bag stack is fully removed from under fence 42 the whole of fence 42 together with the partially formed stack of bags resting on end 58 settles downward onto conveyor 12 as shown in FIG. 9. At this point the conveyor and clamp mechanism motion is halted and clamp mechanism 68 is rotated to raise ends 102 as shown in FIG. 10. Clutch 106 then releases and pneumatic piston 88 reciprocates in the other direction with the result that clamp mechanism 68 is returned to its leftward position while conveyor 12 remains stationary. This brings the cycle back to the point where the description started.

The equipment provides adjustments to accommodate to various bag sizes and stack heights. Stack thicknesses may be accommodated by a adjustment of handle 28 to move the fence assembly and clamp assembly supported on pillars 16 to the appropriate distance above conveyors 12. Various bag lengths can be accommodated by adjusting the position of the fence assembly along ways 30 and by adjusting the throw of cylinder 88. The position of clamp assembly 68 to right or left can be, adjusted by disengaging rack 90 from pinion 86 and rotating pinion 86.

Important advantages of the described embodiment of the invention include the clean separation of bags in successive stacks without risk of crumpling any bags, due to the sharp edges on the clamp mechanism that is presented to oncoming bags and the rapid rotation of the clamp; the prevention of bags from being prematurely drawn beneath the fence by the finger ends, and generally the capability to stack an uninterrupted stream of incoming bags into non-overlapping piles.

What is claimed is:

1. A stacker for producing stacks of flat plastic bags and the like, said stacker being of the known type comprising an intermittently movable conveyor for receiving a series of forwardly projected bags, a fence positioned over said conveyor for stopping said bags so that they accumulate as a stack, means for raising the fence to allow forward movement of a completed stack and a clamp operable when the desired stack is formed for engaging the top of the stack, to press the stack downwardly against the conveyor, said conveyor and clamp thereupon movable together forwardly beneath the raised fence to advance the stack, that improvement comprising a receiver surface operative to lie over said conveyor and stack and extending to said fence when said fence is in raised position, said receiver surface adapted to receive bags thereupon while said clamp moves forwardly with the previously formed stack, said receiver surface movable forwardly beyond said fence whereby bags formed during forward motion of said clamp are released to fall by gravity upon said conveyor, and freeing said receiver surface to return above the next completed stack for repetition of the cycle.

2. The stacker of claim 1, wherein said receiver surface terminates rearwardly in a narrow edge facing incoming bags.

3. The stacker of claim 1, wherein said receiver surface comprises a support movable with said clamp during forward movement of a clamped stack.

4. The stacker of claim 1, wherein said receiver surface is independent of said clamp, constructed to remain in receiving position while said clamp moves entirely beyond said fence.

5. The stacker according to claim 4 characterized in having fingers that have lower, trailing ends that provide said receiving surface, said fingers being movable between raised and lowered levels and between rearward and forward positions, said ends extending rearwardly beyond said fence in said rearward position; a bag support arranged to lie, when said clamp engages a completed stack of bags, in a position rearward of said fence and above said completed stack, said support adapted to receive incoming bags arriving subsequently to the completion of said stack, said support being arranged to move forward of said fence to disengage said bags, said fingers and support being arranged so that said finger ends at their raised level are positioned above said stack and below said support, and means for moving said fingers to said forward position prior to raising said fingers and to said rearward position when said fingers are raised and before said support is moved entirely forward, thereby to insert said finger ends into the space below any accumulated incoming bags, in position to receive said bags when said support is moved forward.

6. The stacker according to claim 5 characterized in that said receiving surface is provided by fingers mounted to move up and down with said fence.

7. The stacker according to claim 6 characterized in that said fingers are exposed in a rearward position to bear upon a completed stack establishing the position of said fence.

8. The bag stacker according to claim 1 wherein supports for said clamp and fence are adjustable vertically together on ways over a range of levels above said conveyor, and said fence is mounted on rotary arms pivoted to said supports and arranged to carry said fence close to said conveyor in bag-stopping position over said range of adjustment.

9. Apparatus as claimed in claim 8, wherein said fence is mounted on a parallelogram linkage whereby its angular relation to approaching bags does not substantially vary over said range of adjustment.

10. The stacker according to claim 1 characterized in that the means providing said receiving surface comprises fingers movable rearward of said fence and said clamp comprises clamp members movable between said fingers.

11. In a bag stacker for plastic bags and the like having a fence for stopping forwardly projected bags so that they accumulate in a stack and raisable to permit completed stacks to move forward, a movable conveyor passing beneath said fence, and a clamp for clamping completed stacks of bags against said conveyor and moving with said conveyor to draw completed stacks forward beneath said fence, the improvement comprising a bag support arranged to assume, when said clamp engages a completed stack of bags, a position rearward of said fence and above said clamp and the completed stack clamped thereby, to receive incoming bags thereon thereby supporting bags arriving subsequently to the clamping of a completed stack by said clamp, said support being further arranged to move forward of said fence so as to disengage bags accumulated thereon, fingers extending below said fence and having trailing ends, said fingers being movable to a raised and a lowered level and from a rearward position wherein said ends extend rearwardly beyond said fence to a forward position in which said ends do not extend rearwardly of said fence, said clamp, fingers, and support being arranged so that at their raised level said finger ends are positioned above said clamp and below said support, means for moving said fingers to said forward position prior to raising said fence and to said rearward position when said fence is in its raised position and before said support is drawn forward of said fence to insert said finger ends into the space between, said clamp and said support and thereby between completed and partial stacks.

12. Apparatus as claimed in claim 11, said support joining said clamp in a narrow edge facing incoming bags.

13. Apparatus as claimed in claim 11, the weight of said fence being counterbalanced so that said fence rests lightly on said conveyor.

14. Apparatus as claimed in claim 11, said clamp having a range of movement to move stacks entirely past said fence, thereby forming non-overlapping stacks.

15. Apparatus as claimed in claim 11, said support and clamp being vertically adjustable to accommodate various stack heights.

16. In a bag stacker for plastic bags and the like having a fence for stopping forwardly projected bags so that they accumulate in a stack and raisable to permit completed stacks to move forward, a movable conveyor passing beneath said fence, and a clamp for clamping completed stacks of bags against said conveyor and moving with said conveyor to draw completed stacks forward beneath said fence, the improvement wherein supports for said clamp and fence are adjustable vertically together on ways over a range of levels above said conveyor, and said fence is mounted on rotary arms pivoted to said supports and arranged to carry said fence close to said conveyor in bag-stopping position over said range of adjustment, said apparatus including means for raising said fence and for releasing said fence to fall by gravity, and counterbalance means adjusting the effective weight of said fence to enable said fence to rest lightly upon a stack of bags being moved by said conveyor.

17. In a bag stacker for plastic bags and the like having a fence for stopping forwardly projected bags so that they accumulate in a stack and raisable to permit completed stacks to move forward, a movable conveyor passing beneath said fence, and a clamp for clamping completed stacks of bags against said conveyor and moving with said conveyor to draw completed stacks forward beneath said fence, the improvement wherein said conveyor comprises an endless conveyor belt including an upper segment arranged in a given path for conveying said stacks, said clamp mounted to travel in a path parallel to said upper segment, a drive belt associated with said clamp, sprockets for driving said conveyor and drive belts, an adjustable stroke rack for driving said sprockets in dependent motion in stack-conveying direction, and clutch means enabling reverse motion only of said drive belt driving return motion of said rack.

* * * * *